US005601215A

United States Patent [19]

Stolz

[11] Patent Number: 5,601,215

[45] Date of Patent: Feb. 11, 1997

[54] CLOSURE FOR A CONTAINER

[75] Inventor: Bernd Stolz, Neunkirchen, Germany

[73] Assignee: Heinrich Stolz GmbH & Co. KG, Germany

[21] Appl. No.: 444,009

[22] Filed: May 18, 1995

Related U.S. Application Data

[63] Continuation-in-part of Ser. No. 340,589, Nov. 16, 1994.

[30] Foreign Application Priority Data

May 19, 1994 [DE] Germany ..... 44 17 492.6
Feb. 16, 1995 [DE] Germany ..... 19 505 142.2

[51] Int. Cl.[6] ..... B65D 25/44

[52] U.S. Cl. ..... 222/529; 222/530; 222/541.9; 222/569

[58] Field of Search ..... 222/529, 530, 222/541.6, 541.9, 569

[56] References Cited

U.S. PATENT DOCUMENTS

| | | | |
|---|---|---|---|
| 2,792,976 | 5/1957 | Stewart | 222/569 |
| 2,981,449 | 4/1961 | Perkins | 222/569 X |
| 3,042,272 | 7/1962 | Anderson | 222/569 X |
| 3,101,878 | 8/1963 | Bee | 222/569 X |
| 3,204,827 | 9/1965 | Krautkramer | 222/530 X |
| 3,834,597 | 9/1974 | Guala | 222/541.9 X |

FOREIGN PATENT DOCUMENTS

| | | | |
|---|---|---|---|
| 0132904 | 2/1985 | European Pat. Off. . | |
| 1513468 | 2/1968 | France | 222/569 |
| 2578819 | 9/1986 | France | 222/529 |
| 836149 | 4/1952 | Germany . | |
| 2502441 | 7/1976 | Germany | 222/569 |
| 1924824 | 3/1978 | Germany | 222/529 |
| 8715950 | 10/1988 | Germany . | |
| 3832412 | 4/1989 | Germany . | |
| 9000007 | 4/1990 | Germany . | |
| 4001824 | 7/1990 | Germany . | |
| 8002546 | 11/1980 | WIPO | 222/529 |

*Primary Examiner*—Kevin P. Shaver
*Attorney, Agent, or Firm*—Speckman, Pauley & Fejer

[57] ABSTRACT

A closure for a container. The closure has a lower closure element and a closure cap which can be placed on the lower closure element. The lower closure element can be connected to the opening of a container by a base element having a contact flange that rests on the inner wall of the container against a contact face formed in the area of the opening of the container. One or several locking projections are disposed on the base element in the axial direction of the container closure and at a distance from the contact flange. The locking projection extends over the rim of the opening, so that the lower container element is held axially immovable in the container. Secure fixing of the container closure in the opening of the container is possible by providing the base element with one or a plurality of stops which come into operational connection with counter-elements of the container and prevent turning of the base element in the opening.

17 Claims, 1 Drawing Sheet

CLOSURE FOR A CONTAINER

CROSS-REFERENCE TO RELATED APPLICATIONS

This application is a continuation-in-part of my earlier filed U.S. patent application Ser. No. 08/340,589, filed Nov. 16, 1994.

BACKGROUND OF THE INVENTION

1. Field of the Invention

This invention relates to a closure for a container with a lower closure element and a closure cap which can be placed on the lower closure element. The lower closure element is connected to the opening of a container by a base element having a contact flange which rests against the inner wall of the container against a contact face formed in the area of the opening of the container. One or more locking projections are disposed on the base element in the axial direction of the container closure and at a distance from the contact flange. The locking projections extend over the rim of the opening, so that the lower closure element is held axially immovable in the container.

2. Description of Prior Art

Generally, closures of the type described above are employed for containers which are filled with a substance under pressure. The contact flange is pressed against the contact face because of the pressure difference with the atmosphere surrounding the container, so that the container closure cannot be pushed out of the opening. A container closure of this type is taught by German Patent Publication DE 38 32 412 A.

Locking projections which extend over the opening of the container are provided on the base element for the axial fixation of the container closure. The base element is thus clamped between the locking projections and the contact flange of the portion of the container facing the opening. If a force is applied to such a container closure in the direction of the circumference of the closure cap, for example when a screw cap is unscrewed or removed, the base element rotates in the opening.

SUMMARY OF THE INVENTION

It is one object of this invention to provide a container closure of the type mentioned at the outset which can be securely fixed in place in the opening of the container.

These and other objects of this invention are achieved with a base element that includes one or several stops which come into operational contact with counter-elements of the container and prevent a rotation of the base element in the opening.

Thus, the base element of the locking element is held in the circumferential direction by the stops. A force required, for example, for unscrewing or removing a screw cap, can be applied to the container via the stops and the counter-elements.

In accordance with one preferred embodiment of this invention the stops are shaped as tabs which are laterally formed on the contact flange and project radially beyond it, and the counter-elements are shaped as cams formed on the container.

Preferably the counter-elements are disposed at even distances from each other. When fitting the container closure into the opening of the container, the stops extend into free spaces formed between the cams. Lateral faces of the stops rest against the counter-elements to prevent the base element from rotating with respect to the container.

To prevent the stops from breaking off or resiliently deforming when the stops are placed on the counter-elements during fitting of the container closure on the opening of the container, the stops are preferably formed as one piece with the base element and are resiliently formed at least in the area of securing with the base element. The stops therefore give resiliently. If the lower closure element is turned a further distance, the stops slide over the counter-elements and spring into locked positions behind them.

According to one preferred embodiment of this invention, the stops are recessed with respect to the inner wall in recesses of the container, or the stops end flush with the wall. The contact face of the container is folded toward the outside with respect to the inner wall and forms a circular receptacle. The contact flange of the base element can be inserted into this receptacle so that it terminates flush with the inner wall of the container, or is recessed with respect to the inner wall of the container. Thus, the contact flange or the stops do not project into the interior of the container and the material can be completely removed without obstruction.

A solid connection between the container and the container closure is achieved by a locking projection that is formed on the base element as a circumferential collar. The locking projection has a deflection slope slowly rising in the direction toward the closure cap and makes a transition into a steep locking flank which rests about the rim of the opening on the outside of the container.

Unintentional pushing of the container closure into the container is prevented because the steep locking flank is supported circumferentially on the outside of the container. Furthermore, the circumferential locking projection prevents severing of the locked connection even if forces are introduced obliquely or in an off-centered manner into the container closure.

If at least the locking projection and the contact flange of the base element are made of a resilient plastic material, the rim of the opening is maintained braced and without play between the locking projection and the contact flange. The contact flange sealingly rests against the contact face of the container, and thus it is possible to provide simultaneously a seal without the aid of additional sealing elements when the container closure has been firmly braced on the container.

According to another preferred embodiment of this invention, the exterior dimensions of the base element are the same or less than the dimensions of the opening. The base element is provided with a chamfer, by which the base element can be threaded from the inside into the opening of the container. The exterior size of the closure cap is smaller than the size of the opening. Thus, it is possible to preassemble the closure element and the closure cap as a structural unit which can be connected with the container in a single assembly step. The base element of the lower closure element is preferably provided with a chamfer to make assembly easier.

For the simple removal of the material from the container, an elastic, axially extractable bellows is connected to the base element of the lower closure element which makes a transition into a pouring spout having an exterior thread on which the closure cap is screwed. A sealing plate with a handle is inserted into the pouring spout. The bellows can be extracted from the container closure and the closure cap can subsequently be removed. As a result, the handle of the sealing plate is accessible so that it can be removed from the pouring spout. The material can then be removed from the container through the pouring opening formed by the pouring spout.

BRIEF DESCRIPTION OF THE DRAWINGS

This invention will be described in conjunction with the drawings, wherein.

DESCRIPTION OF PREFERRED EMBODIMENTS

Figure 1:
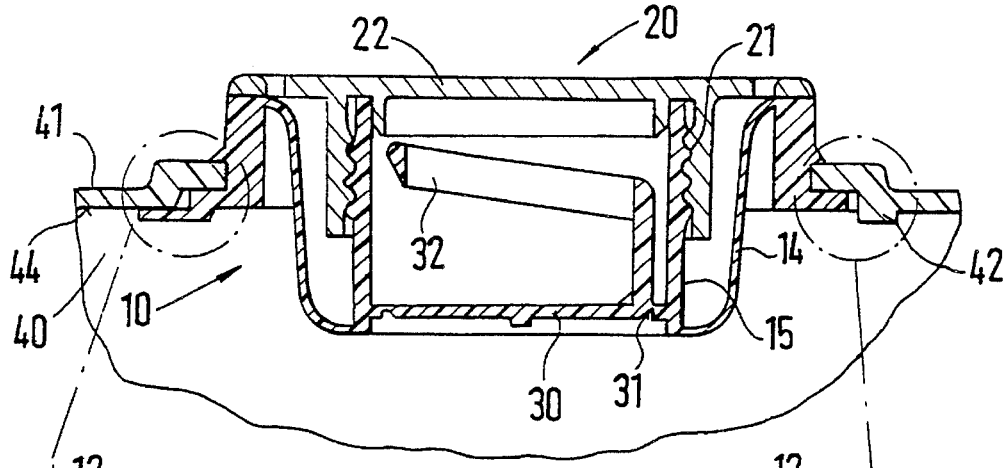
FIG. 1 is a lateral cross-sectional view of a container closure with a closure cap, assembled on a container in accordance with one preferred embodiment of this invention.

A container closure 10 comprising a lower closure element and a closure cap 20 placed on the lower closure element are shown in FIG. 1. The lower closure element has a base element 13, to which an elastically extractable bellows 14 is connected. On its end facing away from the base element 13, the bellows 14 makes a transition into a circular pouring spout 15. The pouring spout 15 comprises an external thread.

A closure cap 20 embodied as a screw cap is screwed on the external thread of the pouring spout 15. The closure cap 20 comprises a lid 22 to which a downwardly extending cylindrical jacket element 21 is connected. The jacket element 21 comprises an interior thread which cooperates with the exterior thread of the pouring spout 15. The pouring opening formed by the pouring spout 15 is closed by a sealing plate 30. The sealing plate 30 is fixed on the interior circumference of the pouring spout 15 by a circumferentially extending predetermined break line 31.

The sealing plate 30 comprises a handle 32 for removing the sealing plate 30 from the pouring spout 15. The handle 32 is formed by a ring and a stem connected to the ring. The stem is directly connected to the sealing plate 30. To remove the sealing plate 30 from the pouring spout 15, the user inserts a finger into the ring and pulls it out of the pouring spout 15. The sealing plate 30 tears along the predetermined breaking line 31 and can be removed from the spout 15. A quality assurance is provided in this way which shows whether the container is used for the first time.

Securing of the container closure 10 on the container 40 is realized by a locking connection. A contact flange 11 and a circumferential locking projection 12 are disposed on the base element 13. The locking projection 12 is disposed a distance from the contact flange 11 and comprises a slowly rising deflection slope in a direction of the closure cap. On its area facing the contact flange 11, the deflection slope makes a transition into a steep locking flank.

The container 40, for example a plastic or metal container, forms an opening. The opening is enclosed by a rim which is followed on the side facing the container interior by a contact face. The contact face is folded over toward the outside with respect to the inner wall 44 formed by the container wall 41.

For assembly, the container closure 10, comprising the lower closure element and the closure cap 20, is preassembled as a structural unit. The exterior dimensions of the closure cap 20 and the base element 13 are less than the exterior dimensions of the opening. Thus, the container closure 10 can be pushed from the inside of the container 40 through the opening. In the process, the rim 42 of the opening slides along the exterior face of the base element 13 until it pushes against the locking projection 12.

Upon a continued pushing movement, the locking projection 12 is deflected radially inward on the rim 42 by virtue of its deflection slope. Once the locking projection 12 has passed the rim 42, the locking projection 12 snaps radially outward into its initial position and in this way is placed with its steep locking flank around the opening on the outside of the container 40. At the same time the contact flange 11 rests against the contact face of the opening.

Figure 1A:
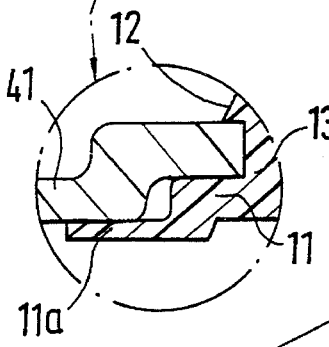
FIG. 1*a* is a lateral cross-sectional view of the left encircled portion of FIG. 1.
Figure 1B:
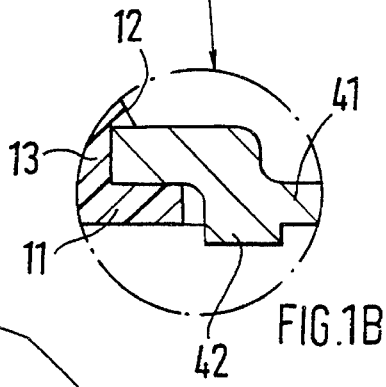
FIG. 1*b* is a lateral cross-sectional view of the right encircled portion of FIG. 1.

As shown in FIG. 1*a*, the contact flange 11 has radially outward projecting stops 11*a*. The stops 11*a* are shaped as tabs and rest against an inner wall 44 of the container 40. As shown in FIG. 1*b*, counter-elements 42 are formed on the container 40 and project past the inner wall 44 of the container 40. The counter-elements 42 cooperate with the stops 11*a* so that twisting of the container closure 10 in the circumferential direction is prevented because the lateral faces of the stops 11*a* are stopped by the counter-elements 42. If, in the course of fitting, the container closure stop 11*a* encounters a counter-element 42, the stop 11*a* bends in the direction away from the inner wall 44 because of its resilience. The lower closure element can be rotated a further distance in the circumferential direction, so the stop 11*a* slides over the counter-element 42 and is locked behind it in its intended position.

Figure 2:
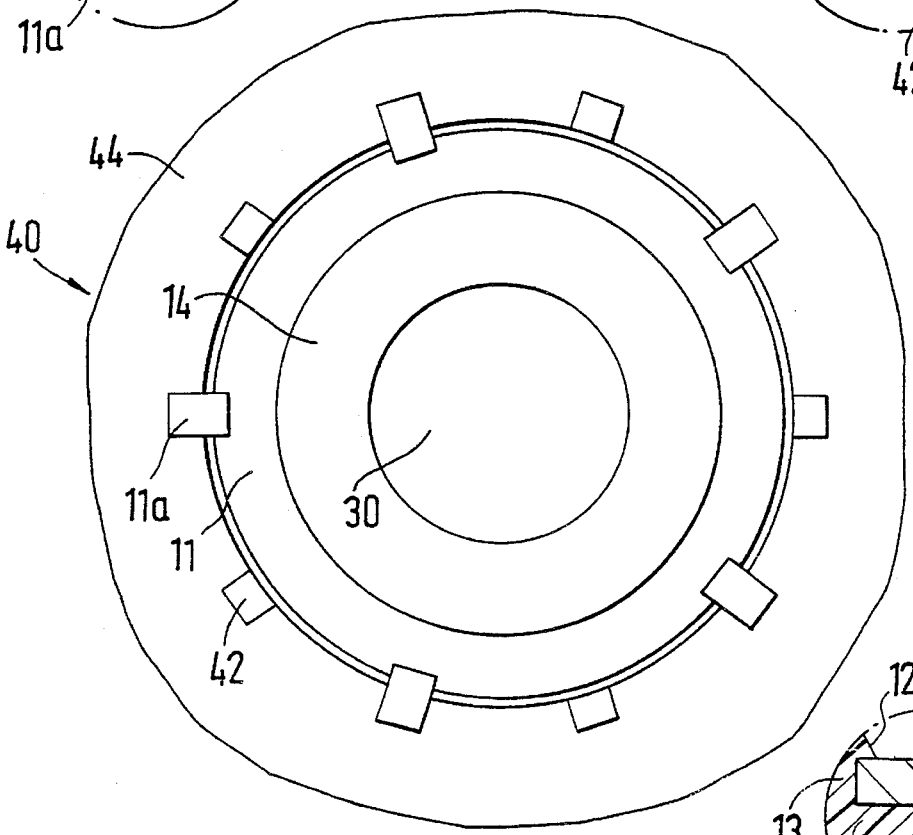
FIG. 2 is a bottom perspective view of the container with a closure cap shown in FIG. 1.

FIG. 2 shows a bottom view, from within the container of the container closure 10 shown in FIG. 1. A plurality of stops 11*a* are disposed distributed over the circumference of the contact flange 11. Further, counter-elements 42, preferably in a number corresponding to that of the stops 11*a*, are disposed on the container 40. In the position of the lower closure element shown in FIG. 2, the lower closure element can be rotated in the circumferential direction only until the stops 11*a* come to rest against the counter-elements 42.

Figure 3:
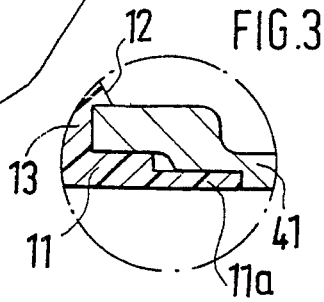
FIG. 3 is a lateral cross-sectional view of a fastening mechanism for attaching a container closure to the opening of the container, according to another preferred embodiment of this invention.

Another preferred embodiment of this invention is shown in FIG. 3, wherein the stops 11*a* terminate flush with the inner wall 44. The inner wall 44 is offset toward the exterior of the container 40 at least in the area of the stops 11*a* to form a receptacle for the stops 11*a*. Thus, material can flow from the container 40 unhampered.

The lower closure element has been formed as a one-piece plastic part. The locking projection 12 and the contact flange 11 in particular are preferably elastic, so that the rim 42 of the container 40 is elastically braced. Such elastic bracing also causes the contact flange 11 to be pressed against the contact face of the container 40, so that a seal is achieved between the contact flange 11 and the contact face.

The locking projection 12 and the contact flange 11 prevent axial movement of the base element 13 with respect to the container 40. The radial locking projection 12 of the lower closure element with respect to the container 40 is prevented in that the dimensions of the groove bottom of the groove formed between the locking projection 12 and the contact flange 11 are adapted to the dimensions of the opening of the container 40.

The invention is not limited to the preferred embodiments shown in the drawings. According to another preferred embodiment of this invention, the contact flange 11 is not a circumferential collar, but rather comprises a plurality of segmented pieces. The sealing effect can be achieved by a sealing plate, for example, or, in accordance with another preferred embodiment the sealing effect is achieved between the rim 42 and the opening and the outer shell of the base element 13. It is also not necessary to provide a circumferential locking projection 12. Rather, a plurality of locking projections 12 which are disposed offset over the circumference of the base element 13 can be provided.

I claim:

1. In a container closure for a container having a lower closure element and a closure cap placed on the lower closure element, the lower closure element connected to an opening of the container by a base element having a contact flange which rests on an inner wall of the container against a contact face formed in an area of the opening of the container, at least one locking projection disposed on the base element in an axial direction of the container closure and at a distance from the contact flange, said at least one locking projection extending over a rim of the opening and holding said lower container element axially immovable in the container, the improvement comprising:

at least one stop (11*a*) positioned on the base element (13), at least one counter-element (42) positioned on the container (40), operational contact between the at least one stop (11*a*) and the at least one counter-element (42) preventing a turning of the base element (13) with respect to the opening.

2. In a container closure in accordance with claim 1, wherein the at least one stop (11*a*) has an overall shape as a tab, the at least one stop (11*a*) is laterally positioned on the contact flange (11) and projects radially beyond the contact flange, the at least one counter-element (42) has an overall shape as a cam, and the at least one counter-element (42) is positioned on the container (40).

3. In a container closure in accordance with claim 1, wherein the at least one stop (11*a*) is integral with the base element (13) and at least a portion of the at least one stop (11*a*) near the base element (13) is resilient.

4. In a container closure in accordance with claim 3, wherein the at least one counter-element (42) is recessed with respect to the inner wall (44) of the container (40), and the at least one stop (11*a*) is one of set back with respect to the inner wall (44) in a recess of the container (40) and is positioned flush with the inner wall (44).

5. In a container closure in accordance with claim 4, wherein the contact face of the container (40) is folded toward an exterior of the inner wall (44) and forms a circular receptacle, and the contact flange (11) of the base element (13) is positioned in the circular receptacle and one of terminates flush with the inner wall (44) of the container (40) and is recessed with respect to the inner wall (44).

6. In a container closure in accordance with claim 5, wherein the at least one locking projection (12) is positioned on the base element (13) and has an overall shape as a circumferential collar, the at least one locking projection (12) has a deflection slope slowly rising in a direction toward the closure cap (20) and makes a transition into a steep locking flank which rests about the rim (42) of the opening on the exterior of the container (40).

7. In a container closure in accordance with claim 6, wherein the at least one locking projection (12) and the contact flange (11) of the base element (13) are constructed from a resilient plastic material, so that the rim (42) of the opening is scalably positioned between the locking projection (12) and the contact flange (11), and the contact flange (11) is sealingly positioned against the contact face of the container (40).

8. In a container closure in accordance with claim 7, wherein the diameter of the base element (13) is one of about the same and less than the diameter of the opening, and the base element (13) has a chamfer by which the base element (13) can be threaded into the opening of the container (40).

9. In a container closure in accordance with claim 8, wherein a diameter of the closure cap (20) is smaller than the diameter of the opening.

10. In a container closure in accordance with claim 9, wherein an elastic, axially extractable bellows (14) is positioned on the base element (13), the extractable bellows (14) forms a pouring spout (15) having an exterior thread, the closure cap (20) threadedly engages the exterior thread, and a sealing plate (30) with a handle (32) is positioned in the pouring spout (15).

11. In a container closure in accordance with claim 1, wherein the at least one counter-element (42) is recessed with respect to the inner wall (44) of the container (40), and the at least one stop (11*a*) is one of set back with respect to the inner wall (44) in a recess of the container (40) and is positioned flush with the inner wall (44).

12. In a container closure in accordance with claim 1, wherein the contact face of the container (40) is folded toward an exterior of the inner wall (44) and forms a circular receptacle, and the contact flange (11) of the base element (13) is positioned in the circular receptacle and one of terminates flush with the inner wall (44) of the container (40) and is recessed with respect to the inner wall (44).

13. In a container closure in accordance with claim 1, wherein the at least one locking projection (12) is positioned on the base element (13) and has an overall shape as a circumferential collar, the at least one locking projection (12) has a deflection slope slowly rising in a direction toward the closure cap (20) and makes a transition into a steep locking flank which rests about the rim (42) of the opening on the exterior of the container (40).

14. In a container closure in accordance with claim 1, wherein the at least one locking projection (12) and the contact flange (11) of the base element (13) are constructed from a resilient plastic material, so that the rim (42) of the opening is scalably positioned between the locking projection (12) and the contact flange (11), and the contact flange (11) is sealingly positioned against the contact face of the container (40).

15. In a container closure in accordance with claim 1, wherein the diameter of the base element (13) is one of about the same and less than the diameter of the opening, and the base element (13) has a chamfer by which the base element (13) can be threaded into the opening of the container (40).

16. In a container closure in accordance with claim 1, wherein a diameter of the closure cap (20) is smaller than the diameter of the opening.

17. In a container closure in accordance with claim 1, wherein an elastic, axially extractable bellows (14) is positioned on the base element (13), the extractable bellows (14) forms a pouring spout (15) having an exterior thread, the closure cap (20) threadedly engages the exterior thread, and a sealing plate (30) with a handle (32) is positioned in the pouring spout (15).

* * * * *